US007453370B2

(12) United States Patent
Marsilio et al.

(10) Patent No.: US 7,453,370 B2
(45) Date of Patent: Nov. 18, 2008

(54) MERCHANDISE TAG WITH ALARMING FEATURES FOR SECURING TAG TO MERCHANDISE

(75) Inventors: Ronald M. Marsilio, Lake Wiley, SC (US); Christopher J. Fawcett, Charlotte, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 254 days.

(21) Appl. No.: 11/320,092

(22) Filed: Dec. 28, 2005

(65) Prior Publication Data

US 2007/0152835 A1 Jul. 5, 2007

(51) Int. Cl.
*G08B 21/00* (2006.01)

(52) U.S. Cl. ..... 340/686.1; 340/568.1; 340/572.8; 40/299.01

(58) Field of Classification Search ... 340/686.1–686.4, 340/687, 568.1–568.2, 572.8–572.9; 40/299.01
See application file for complete search history.

(56) References Cited

U.S. PATENT DOCUMENTS

2002/0083744 A1* 7/2002 Lai ..... 70/30
2007/0120669 A1* 5/2007 Belden, Jr. ..... 340/568.2

* cited by examiner

*Primary Examiner*—Jeff Hofsass
*Assistant Examiner*—Hongmin Fan
(74) *Attorney, Agent, or Firm*—Sand & Sebolt

(57) ABSTRACT

A merchandising tag comprising a housing with a first compartment defined therein and having a door pivotally mounted thereon to selectively allow or prevent access to the first compartment. The first compartment is adapted to receive a price tag therein. The housing is also provided with an attachment mechanism which has at least one portion which extends outwardly away from the housing is adapted to engage the product. The tag includes at least one alarm system disposed within the housing. A locking mechanism is provided for simultaneously locking the moveable door to prevent access to the first compartment; securing the portion of the attachment mechanism to the product so that the housing is not detachable therefrom; and for arming the at least one alarm system. When the locking mechanism is engaged, any attempt to remove the tag from the product, open the door, or remove the product with attached tag from the store will result in a loud-attention getting sound being emitted from the housing. The locking mechanism is disengaged using a remote magnetic key.

28 Claims, 11 Drawing Sheets

FIG-3
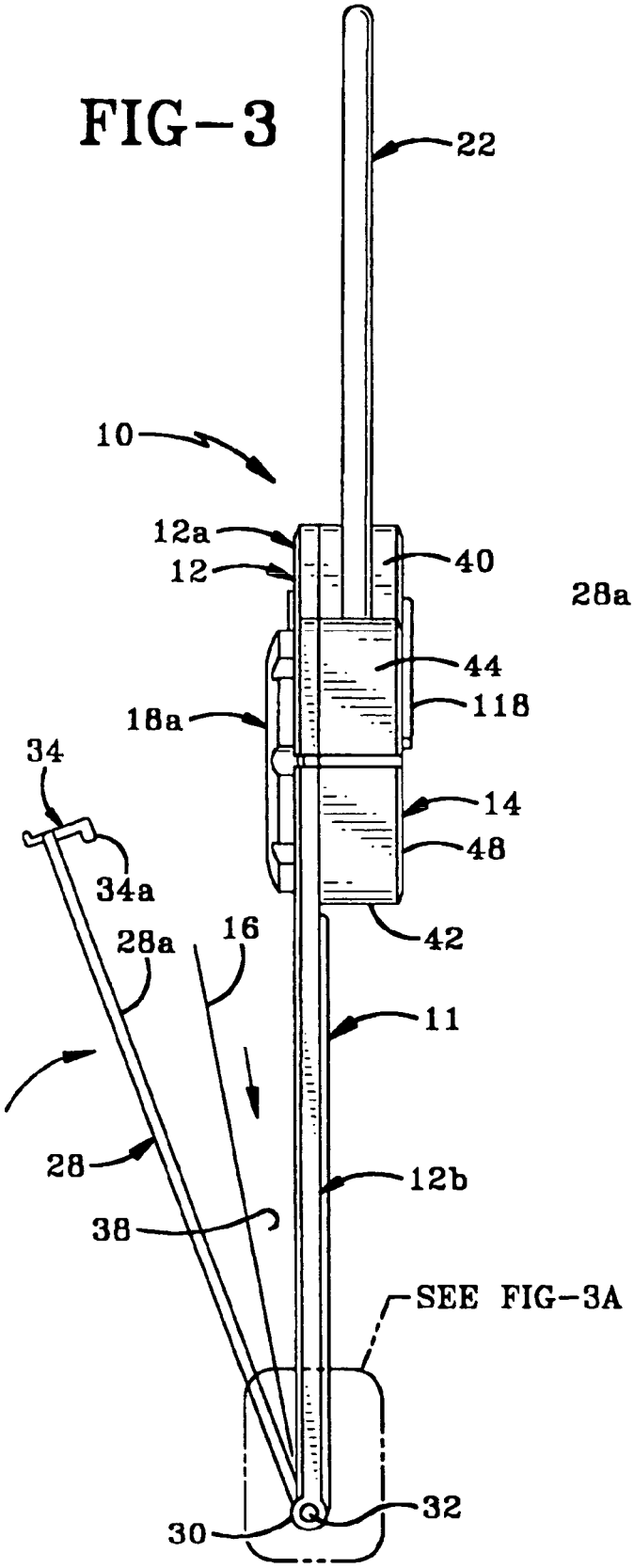
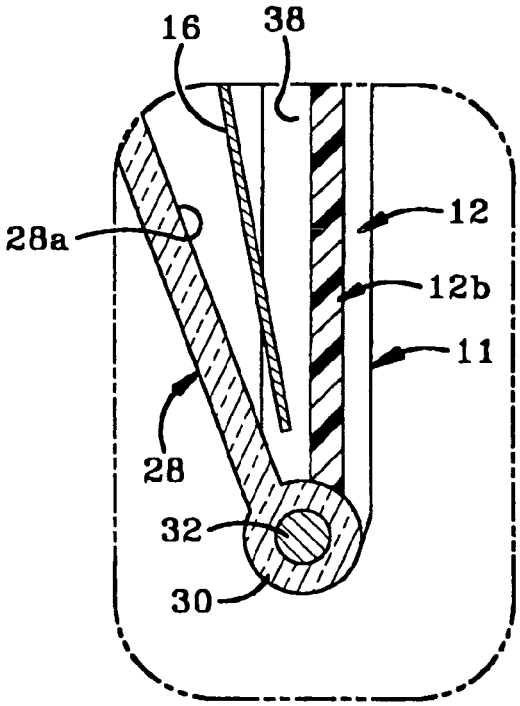
FIG-3A

FIG-4
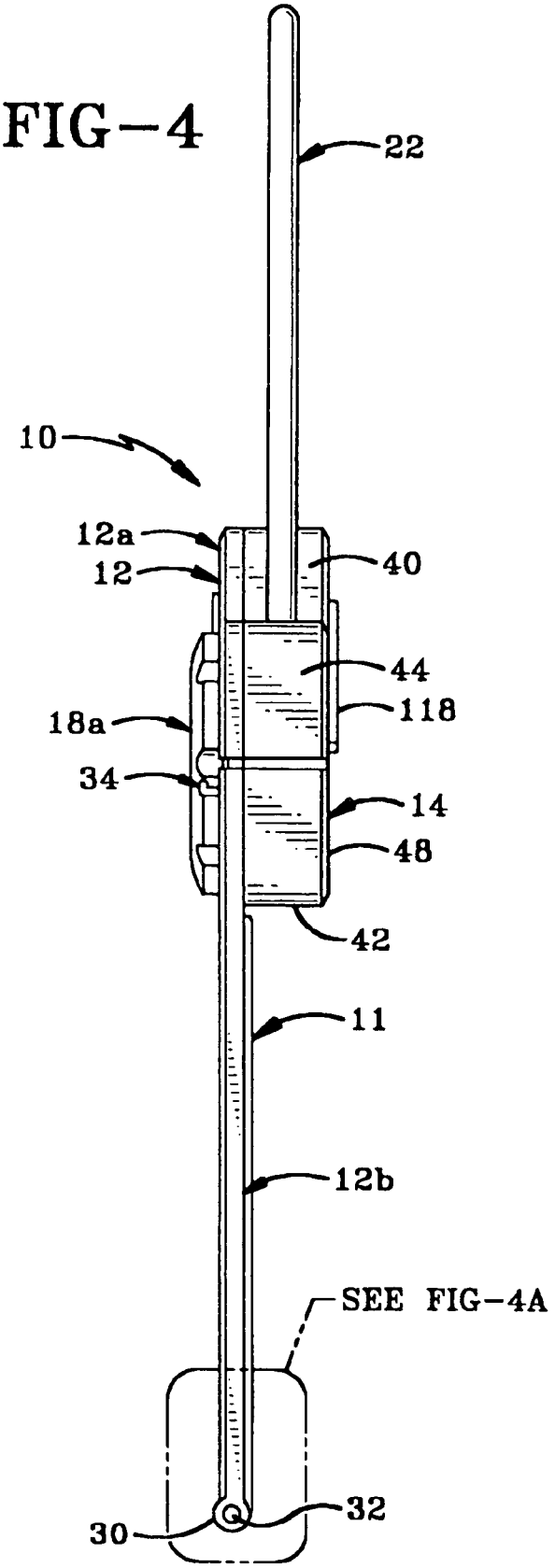
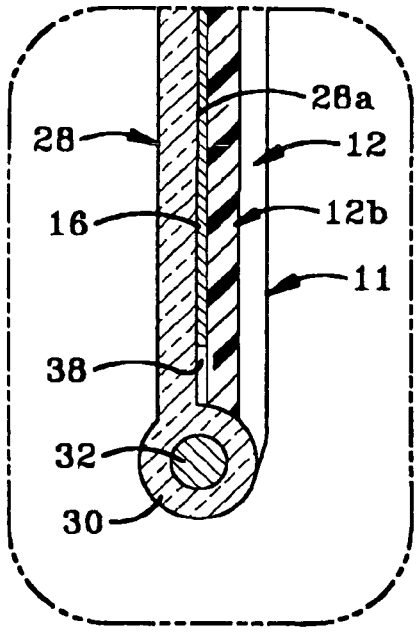
FIG-4A

FIG-7
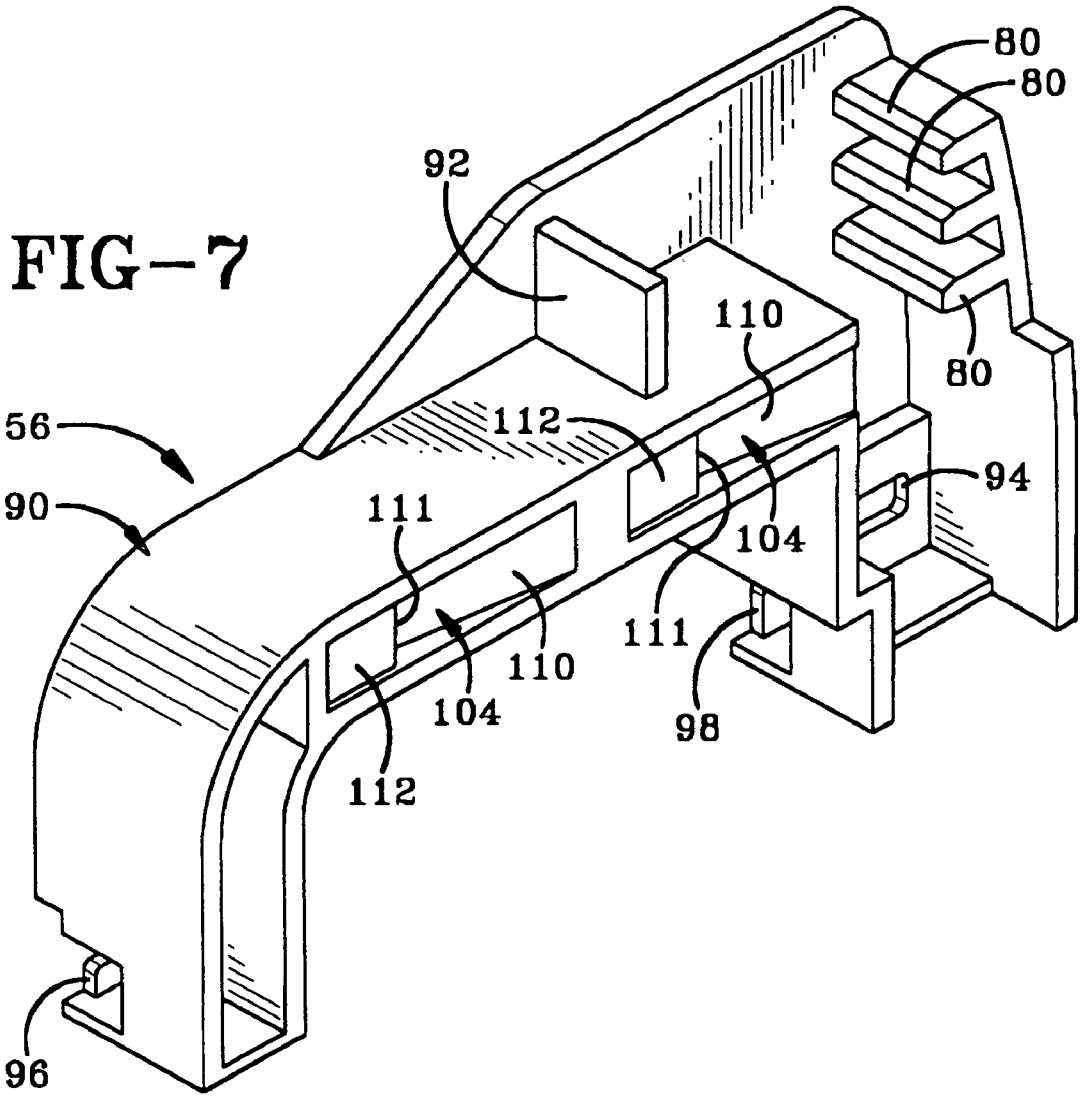
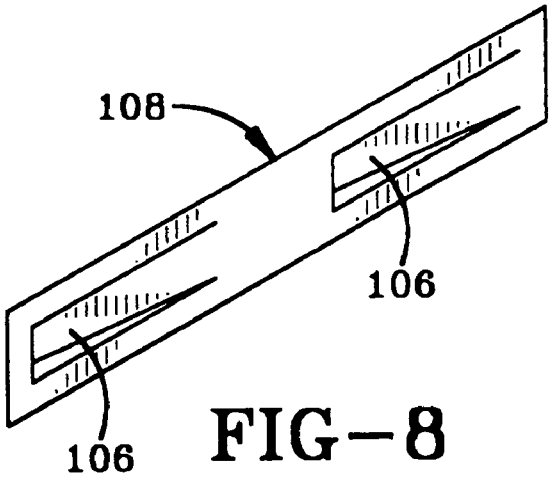
FIG-8

MERCHANDISE TAG WITH ALARMING FEATURES FOR SECURING TAG TO MERCHANDISE

BACKGROUND OF THE INVENTION

1. Technical Field

This invention generally relates to merchandising tags. More particularly, the invention relates to a security tag including an alarm. Specifically, the invention relates to a merchandising tag having a lockable compartment which is adapted to receive a price tag therein and which includes a locking mechanism that simultaneously locks the compartment, secures the tag to a product and alarms the tag.

2. Background Information

Theft is a multibillion dollar problem for the retailing industry. As a result, the industry has instituted various measures and used a variety of security devices to deter would-be thieves and to aid in preventing thieves from removing products from stores. These security devices have covered a wide range of products and retailing display systems.

One of the latest challenges faced by the retailing industry is the switching of price tags between cheaper merchandise and expensive merchandise of the same type and the subsequent legitimate purchasing of the now lower-priced expensive merchandise. It is virtually impossible for a cashier in a large retail store to know what price belongs to which merchandise. It is therefore relatively easy for a thief to take the tag off a cheaper leather jacket, for example, and reattach the same to an expensive leather jacket and then pay for the repriced jacket and leave the store undetected. This method of stealing greatly reduces the thief's risk of being caught and they can always feign ignorance of how the price tag became switched if, for some reason, the incorrect price for the expensive merchandise is detected. Once this stolen product has passed through the detectors at the store exit, it is beyond recovery without the aid of legal authorities.

There is therefore a need in the art for a merchandising tag which will prevent price tag switching between products, which will alert store employees to the fact that the tag has been switched, will activate the door alarms positioned at the store exit and, furthermore, will continue to alert store employees and others of the theft even after the product has be removed from the store.

SUMMARY OF THE INVENTION

The device of the present invention is a merchandising tag comprising a housing with a first compartment defined therein. A door is pivotally mounted on the housing to selectively allow or prevent access to the first compartment. The first compartment is adapted to receive a price tag therein. The housing is also provided with an attachment mechanism which has at least one portion that extends outwardly away from the housing is adapted to engage the product. The tag also has at least one alarm system disposed within the housing. A locking mechanism is provided for simultaneously locking the moveable door to prevent access to the first compartment; securing the portion of the attachment mechanism to the product so that the housing is not detachable therefrom; and for arming the at least one alarm system. When the locking mechanism is engaged, any attempt to remove the tag from the product, open the door, or remove the product with attached tag from the store will result in a loud-attention getting sound being emitted from the housing. The locking mechanism is disengaged using a remote magnetic key.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

FIG. 3 is a side elevational view of the merchandising tag in the open position with a price tag being inserted therein;

FIG. 3A is a cross-sectional enlargement of the highlighted area of FIG. 3;

FIG. 4 is a side elevational view of the merchandising tag in the closed position FIG. 4A is a cross-sectional enlargement of the highlighted area of FIG. 4;

FIG. 7 is a perspective view of the slider;

FIG. 8 is a perspective view of the spring clip which engages the spring pockets of the slider of FIG. 7;

DETAILED DESCRIPTION OF THE INVENTION

Figure 1:
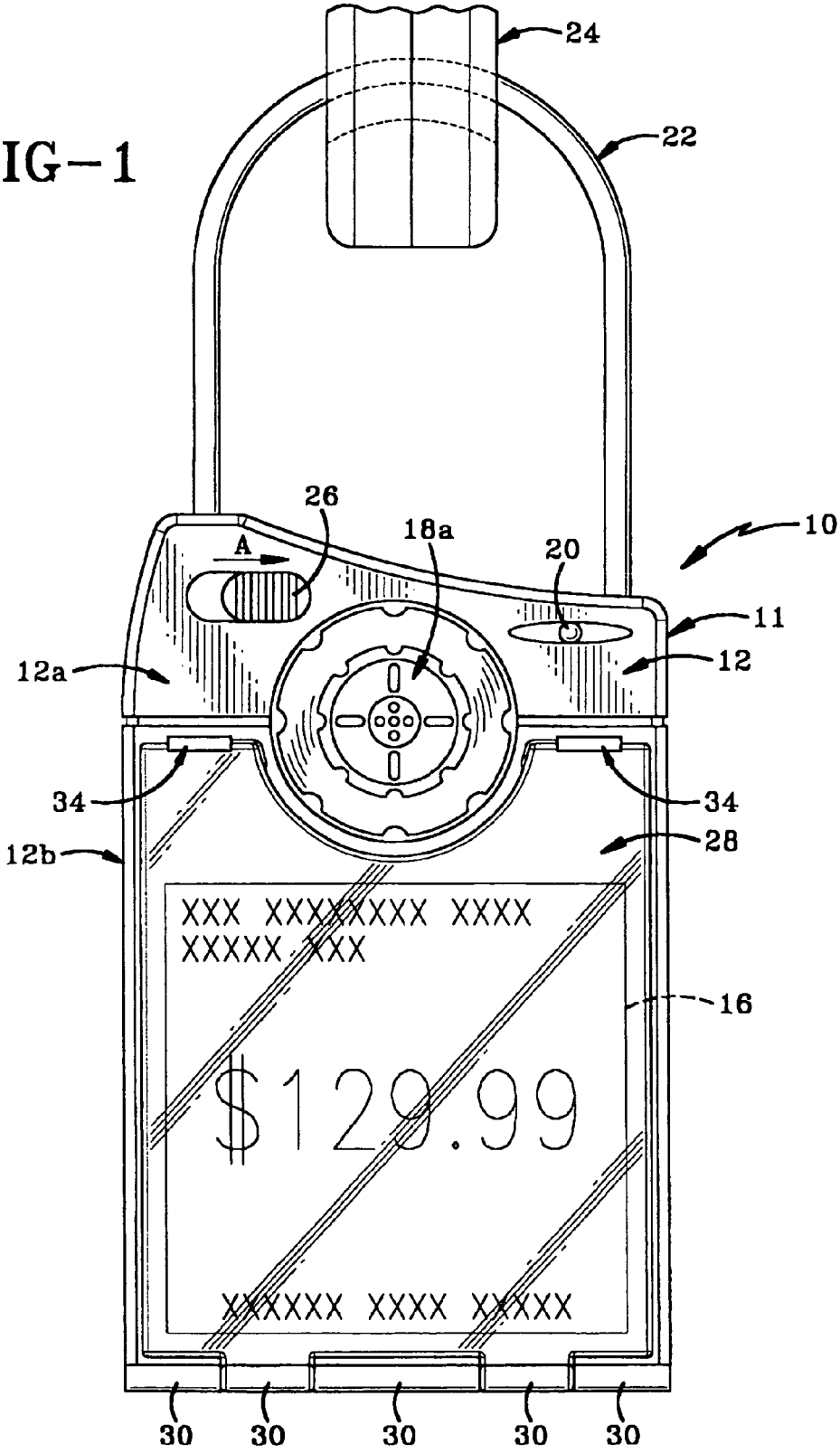
FIG. 1 is a front elevational view of a merchandising tag in accordance with the present invention.

Referring to FIGS. 1-6 there is shown a merchandising tag in accordance with the present invention and generally indicated at 10. Tag 10 comprises a housing 11 having a front 12 and a back 14. Housing 11 is designed to hold a price tag 16 and house the indicators which display to the consumer that merchandising tag 10 is alarmed. Front 12 therefore includes a grill 18*a* for a speaker 18 (FIG. 5) to show the consumer that tag 10 will emit a sound if tampered with and a LED light 20 (light-emitting diode) which shows the consumer that tag 10 is actively alarmed. A cable 22 extends outwardly away from housing 11 and is releasably connects tag 10 to a product 24 as will be hereinafter described.

Front 12 includes an upper section 12*a* and a lower section 12*b*. A slider button 26 and the LED 20 are positioned on upper section 12*a*. Slider button 26 is used to engaging a locking mechanism 59 (FIG. 5) that is disposed within housing 11 as will be hereinafter described. A sound-emitting speaker 18 is disposed partially in upper section 12*a* and partially in lower section 12*b* and projects slightly outwardly from front 12 (FIG. 3). Speaker 18 is mounted in such a manner so as to prevent it from being tampered with to deactivate it or pried off front 12 by a would-be thief.

In accordance with a specific feature of the present invention, a door 28 is pivotally connected to the lower section 12*b* of front 12. The bottom ends of both door 28 and lower section 12*b* are shaped to form hinge sections 30 and a hinge pin 32 is inserted therethrough to pivotally secure door 28 and lower section 12*b* together. The upper end of door 28 includes a pair of latching members 34 each having a projection 34*a* that is receivable through an aperture 36 in front 12. A first compartment 38 is defined between the inner surface 28*a* of door 28 and the outer surface of the front 12 of housing 11. Door 28 is moveable between an open position (FIG. 3) permitting insertion or removal of price tag 16 in first compartment 38, and a closed position (FIG. 4) preventing insertion or removal of price tag 16 from first compartment 38. When merchandising tag 10 is locked (as will be later herein described), latching members 34 are locked into place so that door 28 cannot be moved into an open position to allow access to first compartment 38. When tag 10 is unlocked, door 28 can be moved into an open position to allow access to first compartment 38.

Figure 2:
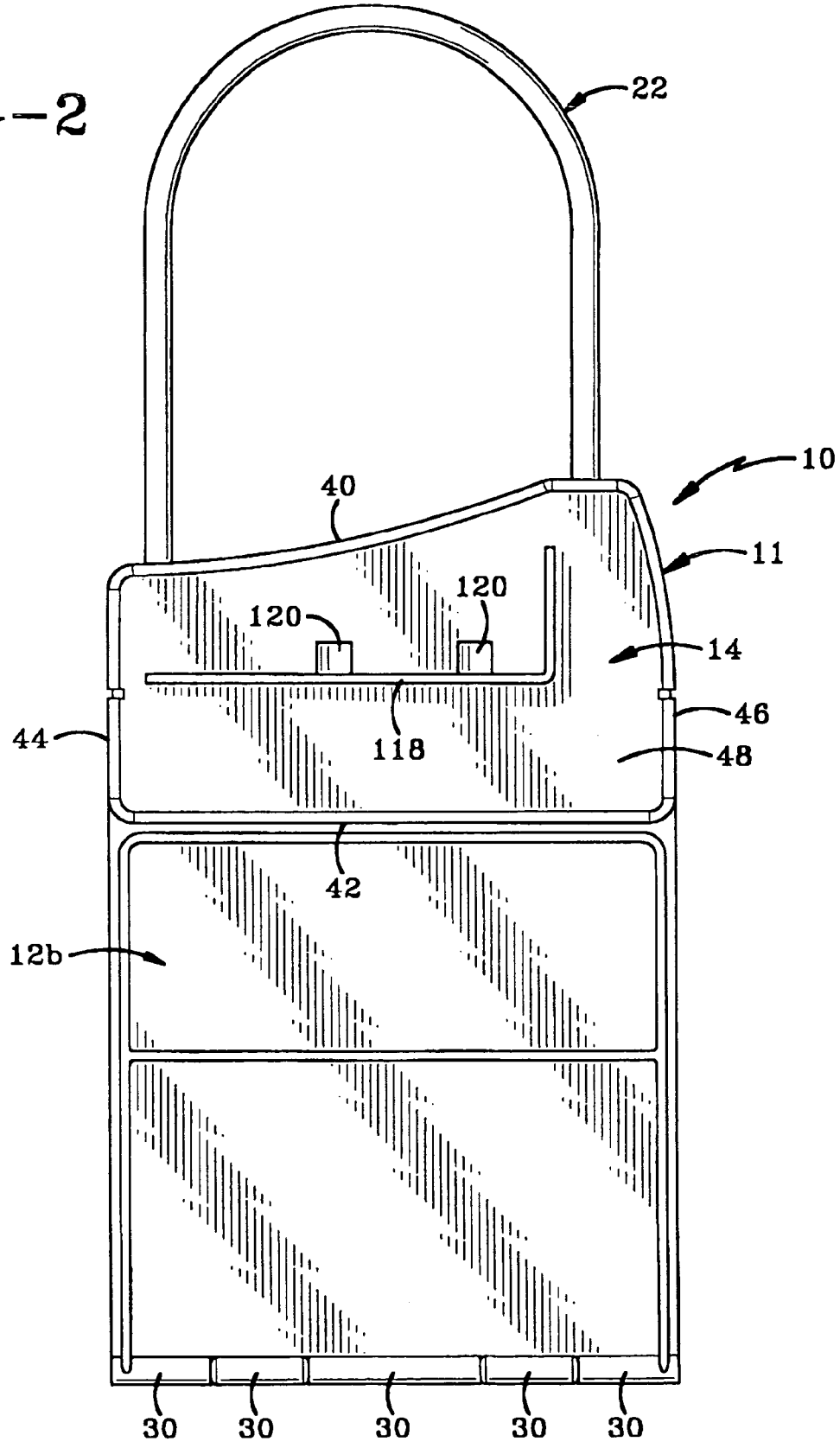
FIG. 2 is a rear elevational view of the merchandising tag of FIG. 1.
Figure 5:
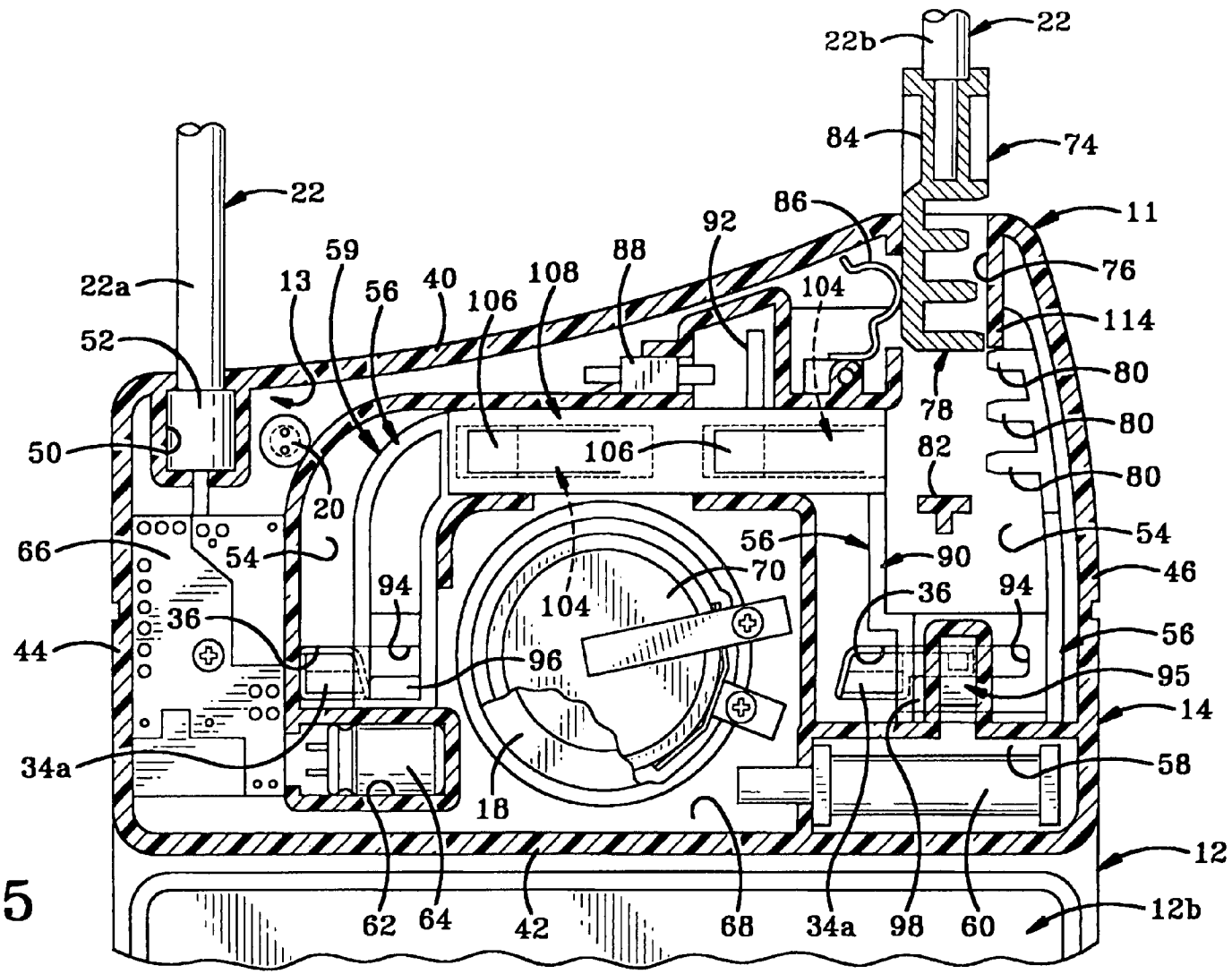
FIG. 5 is a partial cross-sectional elevational view of the upper section of the rear housing with the tag in an unlocked state.
Figure 6:
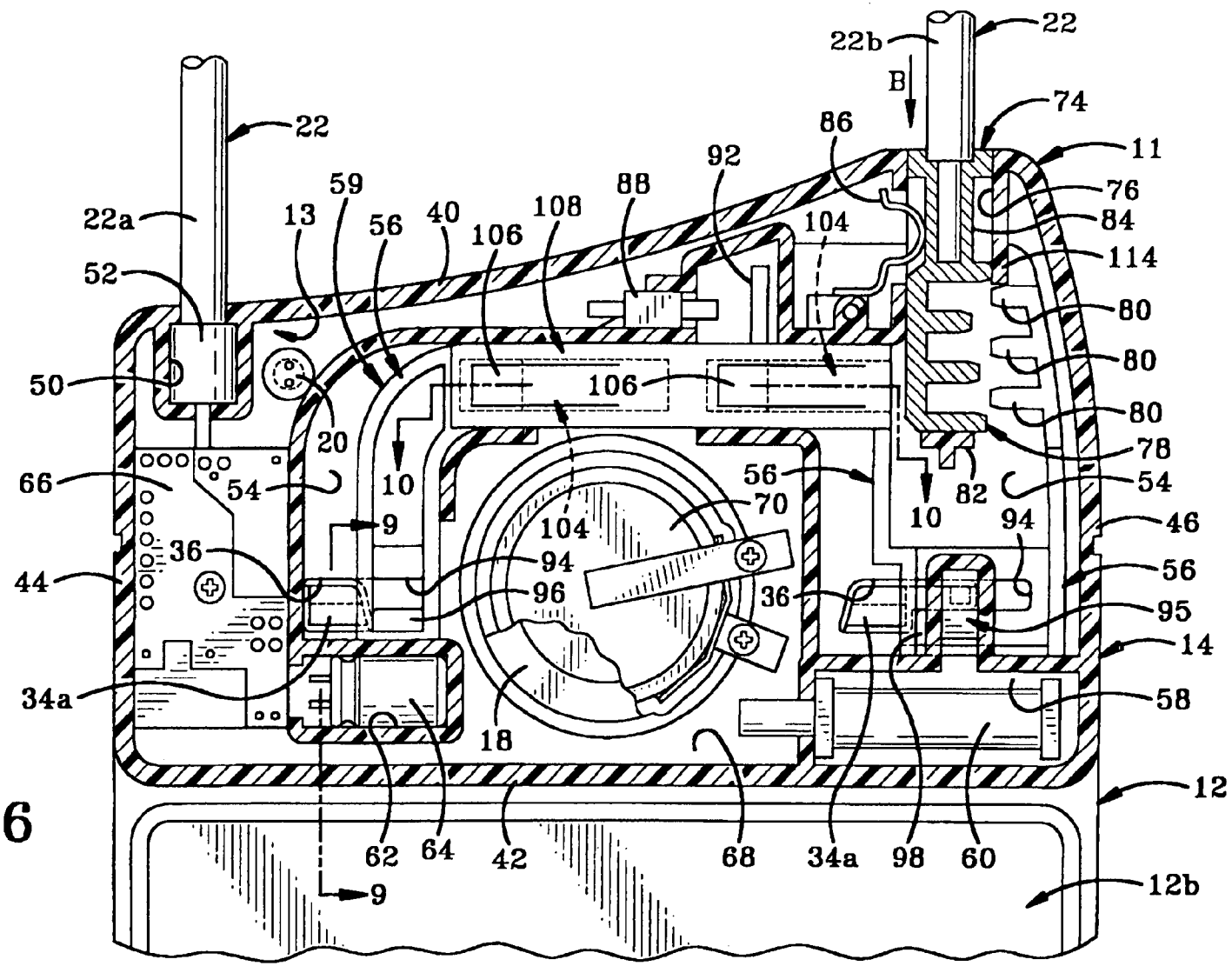
FIG. 6 is a partial cross-sectional elevational view of the upper section of the rear housing showing the bayonet being inserted into the slider.
Figure 9:
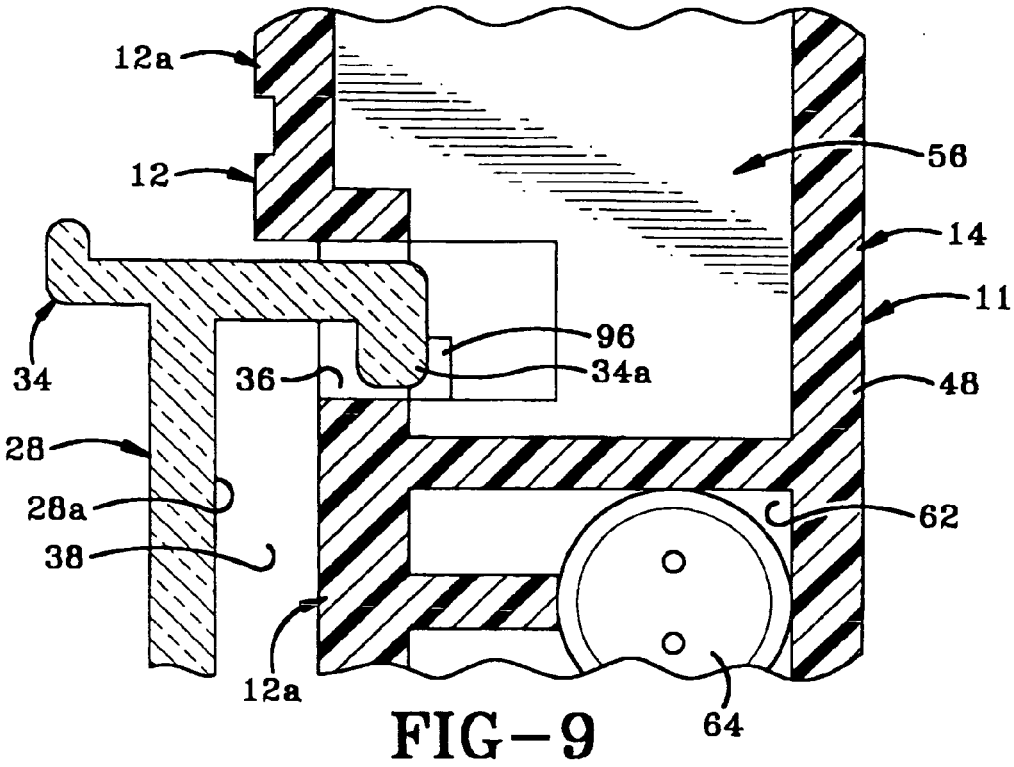
FIG. 9 is a cross-sectional side view of the door latching mechanism through line 9-9 of FIG. 6.
Figure 13:
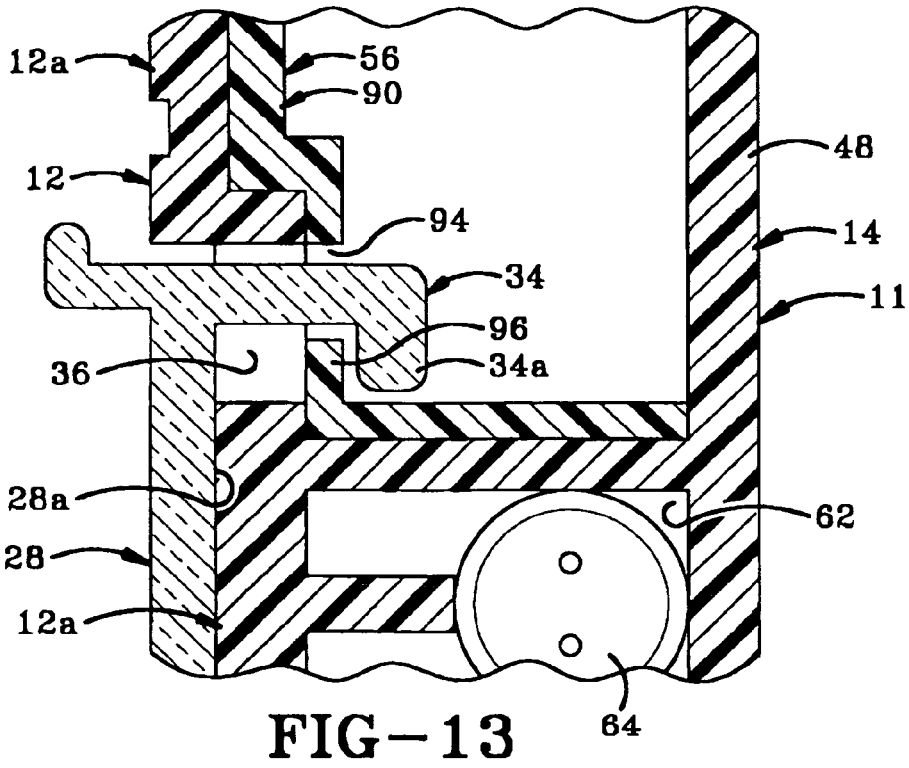
FIG. 13 is a cross-sectional side view of the latching mechanism through line 13-13 of FIG. 12 and showing the latch in locked position.

Back 14 of housing 11 is shown in greater detail in FIGS. 5-6. Back 14 defines a second compartment 13 having an upper wall 40, a lower wall 42, two side walls 44, 46 and a back wall 48 (FIG. 2). Back 14 is also fabricated with a number of internal walls which form differently shaped areas to hold the components of locking mechanism 59 and a three-way alarm system. A first area 50 is formed proximate the upper and side walls 40, 44 of back 14. Area 50 is designed to fixedly hold a ferrule 52 connected to a first end 22*a* of cable 22.

A second area 54 is formed approximately in the middle of back 14 and is shaped to receive a slider 56 and spring clip 108 of locking mechanism 59. Second area 54 is configured to allow slider 56 to move back and forth therein. Slider 56 is used to lock merchandising tag 10 and to activate the alarm systems.

A third area 58 is formed in back 14 to house an EAS tag 60. Tag 60 is adapted to trigger a remote alarm system at a store exit if a remote magnetic key (not shown) is not used to deactivate merchandising tag 10 prior to the customer exiting the store. It will be understood by those skilled in the art that any suitable EAS tag or RFID tag or any other alarm activating device may be used in merchandising tag 10 without departing from the spirit of the present invention.

A fourth area 62 is formed in back 14 to house a capacitor 64 and printed circuit board 66 and a fifth area 68 houses a battery 70 which provides power to merchandising tag 10.

Merchandising tag 10 is secured to a product 24 by way of cable 22. Cable 22 is fixedly secured at a first end 22*a* into housing 11 and is removably attachable at a second end 22*b* thereto. First end 22*a* of cable 22 is fixedly secured within ferrule 52 housed within first area 50. Neither of the ferrule 52 nor the first end 22*a* of cable 22 can be withdrawn from back 14. Ferrule 52 is electrically connected with circuit board 66. Second end 22*b* of cable 22 is fixedly secured to a bayonet 74 which is removably received through an aperture 76 formed in upper wall 40 of housing 11. Aperture 76 allows access into second area 54 of back 14. Bayonet 74 is removably insertable through aperture 76 to engage with slider 56. Bayonet 74 has a generally E-shaped end 78. A stop 82 is provided in housing 11 to arrest the downward movement of bayonet 74 when it is inserted through aperture 76. Bayonet 74 further includes a substantially I-shaped region 84 which engages a contact 86 for a switch 88 when bayonet 74 is locked in place as will be hereinafter described.

Figure 10:
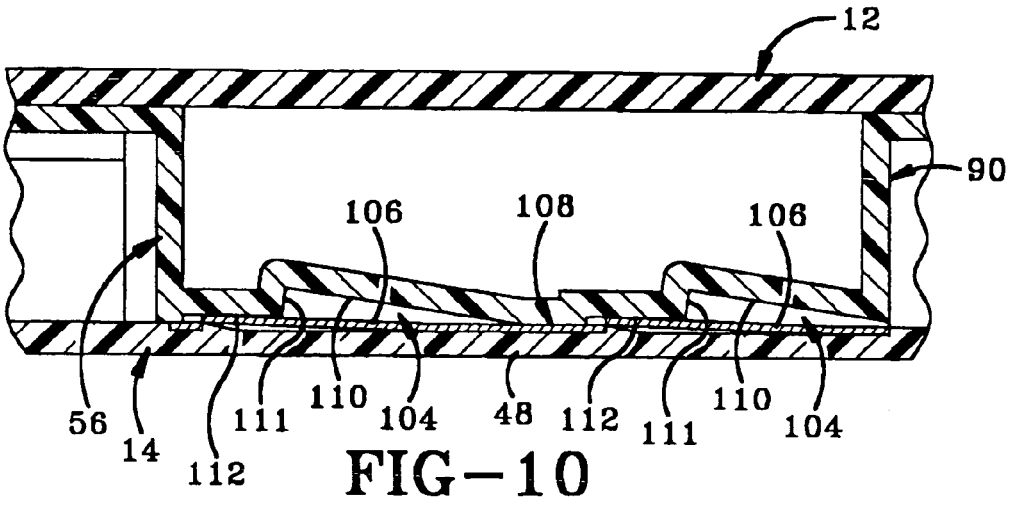
FIG. 10 is a cross-sectional top view of the slider engaged with the spring clip and taken through line 10-10 of FIG. 6.

Slider 56 is shown in greater detail in FIGS. 7&8. Slider 56 comprises a body 90 shaped to be moveably received within second area 54. Locking teeth 80 are formed on body 90 and are shaped and spaced for engagement with the fingers of the E-shaped end 78 of bayonet 74. Body 90 also includes a switch activator 92 for engaging switch 88 (FIG. 5), recesses 94 for receiving latching members 34 of door 28 therethrough, a plunger switch 95 extends through aperture 36 and is activated by latching member 34 as member 34 is inserted through aperture 36 to activate the alarm system, and a pair of projections 96, 98 which slidably engage latching members 34 when slider 56 is moved into engagement with the same. Slider 56 further includes pockets 104 which receive arms 106 of spring clip 108 therein. As may be seen from FIGS. 7 & 8, spring clip 108 is a substantially planar member having arms 106 spring-biased outwardly out of alignment with the planar member. Pockets 104 in slider 56 include a first inclined face 110 (also seen in FIG. 10) which is complementary sized and shaped to receive arms 106 therein and a flattened second face 112. Pockets 104 each further include a third face 111 which arrests the movement of arms 106 when slider 56 is slidingly moved within second area 54 to lock merchandising tag 10. Spring clip 108 is manufactured from a magnetic metal while slider 56 preferably is manufactured from a nonmetallic or nonmagnetic material.

Merchandising tag 10 is used in the following manner to attach a price tag 16 to a product 24. Door 28 is disposed in an opened position (FIG. 3) in order for a price tag 16 to be inserted into first compartment 38 between door 16 and front 12 of housing 11. Door 28 is then moved into a closed position (FIG. 4) so that latching members 34 are received through apertures 36 in front 12. While the door 28 is now in a closed position, it is not locked into place, nor is tag 10 alarmed at this point. The store employee passes cable 22 around an appropriate member of the product 24 or product packaging and then inserts second end 22*b* of cable into aperture 76 in upper wall 40 (FIG. 5). Second end 22*b* of cable 22 is pushed downwardly in the direction of arrow "B" (FIG. 6) until end 78 encounters stop 82. At this point, I-shaped region 84 of bayonet 74 is urged, by contact 86, into engagement with the wall 114 defining aperture 76 (FIG. 6), and is thus held in place, but is not locked.

Figure 14:
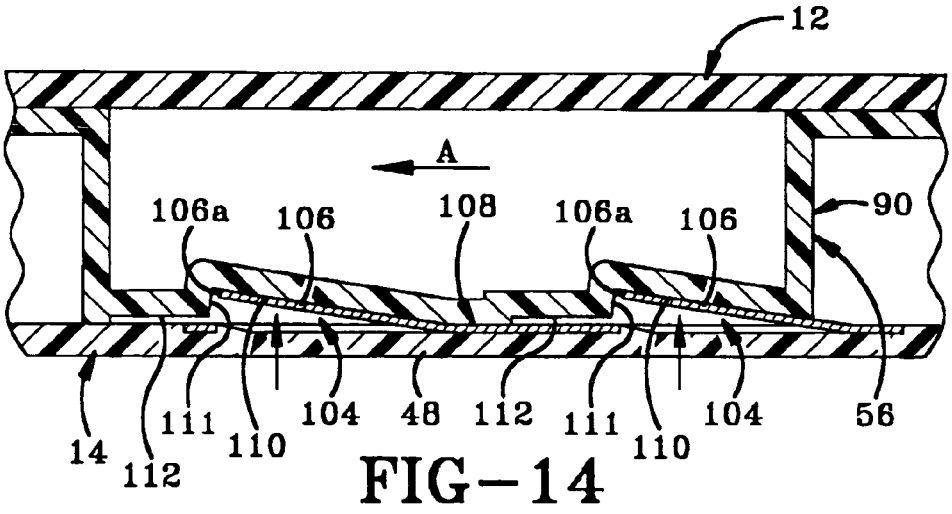
FIG. 14 is a cross-sectional top view of the slider through line 14-14 of FIG. 12.
Figure 12:
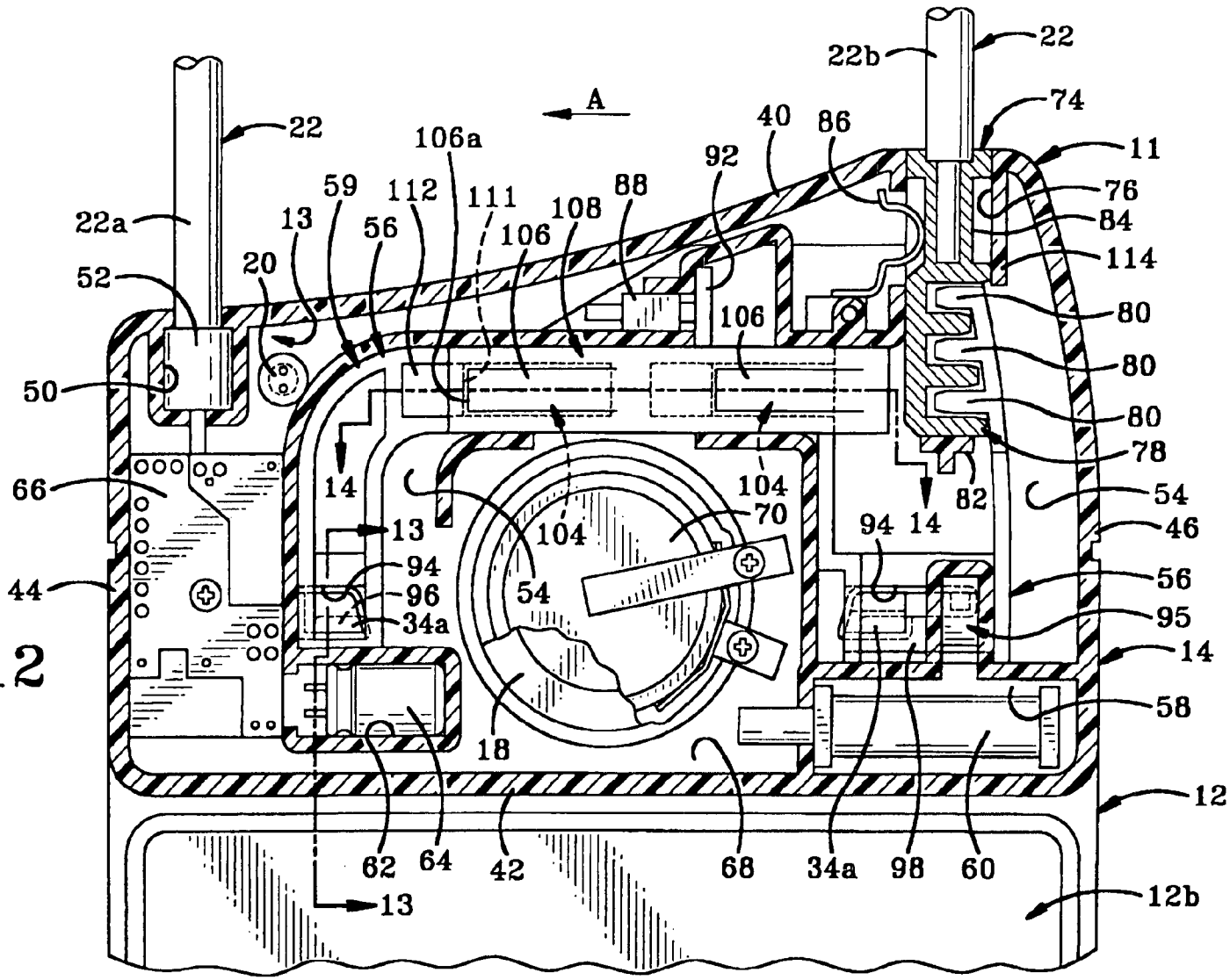
FIG. 12 is a partial cross-sectional elevational view of the rear housing showing the locking mechanism engaged.

In order to lock door 28 in place and alarm tag 10, slider button 26 on front 12 is pushed in the direction of arrow "A" (FIGS. 1&12). Slider button 26 is operationally connected to slider 56 and, consequently, movement of slider button 26 in the direction of arrow "A" causes slider 56 to slide within second area 54 from a first position (shown in FIG. 6) to a second position (shown in FIG. 12). Referring to FIGS. 6, 9, 12 & 13, as slider 56 is moved by slider button (not shown in this figure) in the direction of arrow "A", projections 96, 98 on slider 56 slide in second area 54 and are disposed between projections 34*a* of latching members 34 and rear wall 28*a* of door 28. Projections 34*a* thereby are locked in place in slider 56 and door 28 can therefore no longer be moved into an open position. Movement of slider 56 also causes arms 106 of spring clip 108 to slide into pockets 104 in slider 56 (FIG. 14), thereby allowing arms 106 to be spring-biased into contact with inclined first face 110 of pockets 104. If an attempt is made to move slider 56 in a direction opposite to arrow "A", then the free ends 106*a* will engage third face 111 of pockets 104 and prevent any further movement in that opposite direction. Furthermore, movement of slider 56 in the direction of arrow "A" causes teeth 80 of slider 56 to interlock with the fingers on end 78 of bayonet 74, thus preventing bayonet 74 and end 22*b* of cable 22 attached thereto from being withdrawn out of aperture 76 in housing 11.

Movement of slider 56 from the first position (FIG. 6) to the second position (FIG. 12) also simultaneously closes the electric circuit (not shown) within tag 10 by causing switch activator 92 to contact switch 88. The wiring of tag 10 has not been shown in the attached drawings to simplify the same, but the wiring of such a device would be obvious to one of ordinary skill in the art. Power is provided to the electric circuit by battery 70. The closing of the electric circuit is evidenced by the illumination of LED 20 on front 12 of housing 11.

Slider 56 therefore simultaneously locks door 28 into the closed position, locks second end 22*b* of cable 22 into second area 54 of housing 11 thus preventing tag 10 from being detached from product 24 and activates one or more of the alarms disposed within housing, i.e., speaker 18 and EAS tag 60.

Figure 16:
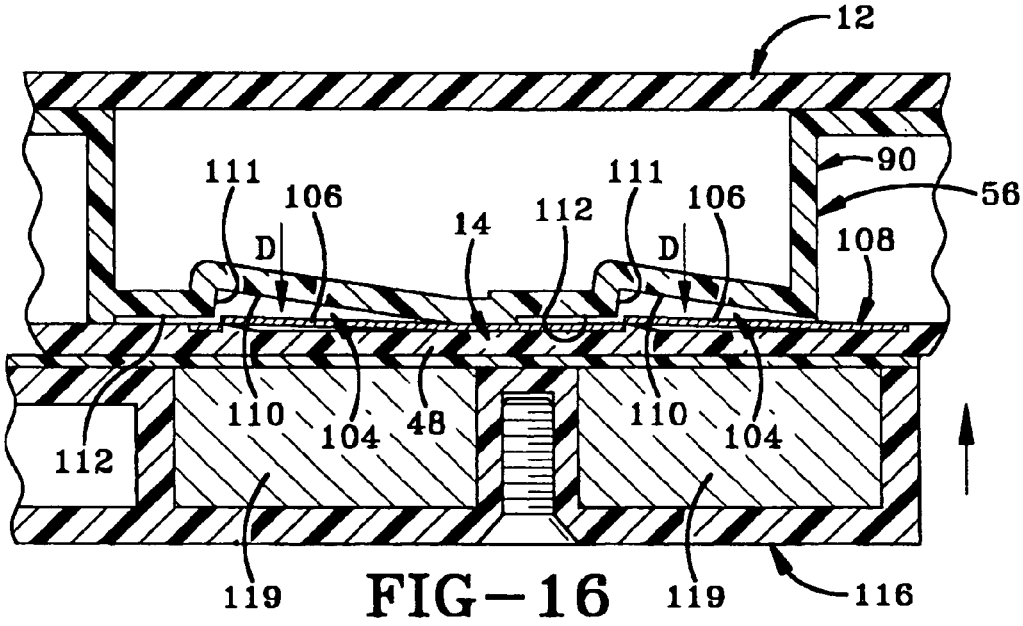
FIG. 16 is cross-sectional top view of the slider with the locking mechanism being disengaged by the key.
Figure 11:
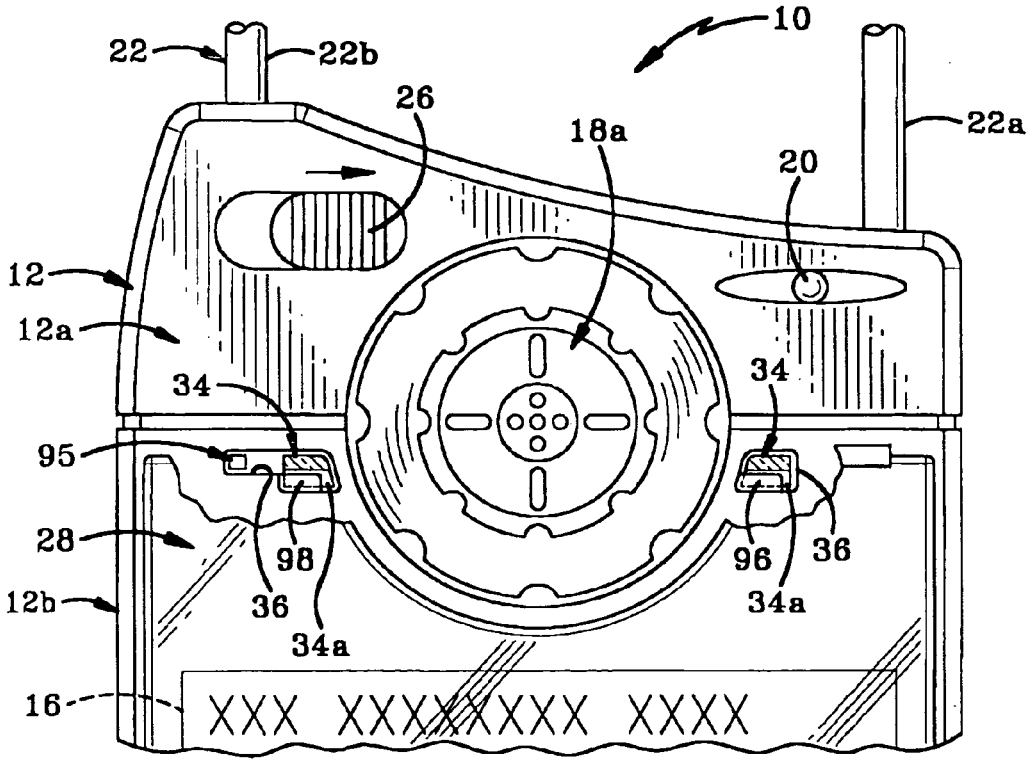
FIG. 11 is partial cut-away front view of the upper section of the front housing showing the locking mechanism being engaged.
Figure 15:
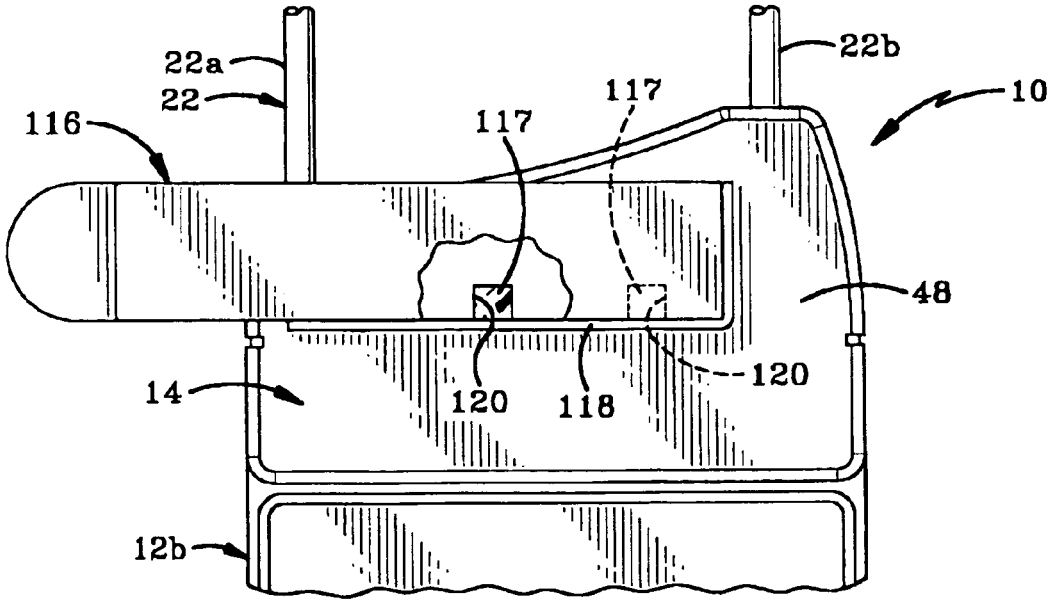
FIG. 15 is a partial cut-away rear view of the rear housing showing the key engaging in the same.

Referring to FIGS. 2, 15 & 16, merchandising tag 10 can only be deactivated using a specially designed remote magnetic key 116. Back wall 48 (FIG. 15) of housing 11 includes an L-shaped key guide 118 and has a pair of spaced-apart alignment holes 120 positioned adjacent key guide 118. Key 116 includes a pair of alignment posts 117 that are spaced apart to align with alignment holes 120 when key 116 is moved along key guide 118. When key 116 is correctly positioned, the magnets 119 in key 116 attract the arms 106 of spring clip 108 toward them. This attraction causes arms 106 to be withdrawn from pockets 104 in the direction of arrow "D" thereby causing arms 106 to move back into alignment with the planar portion of clip 108 (FIG. 16). The user can then move slider 56 in a second direction opposite to arrow "A", thus causing projections 96 and 98 to slide out from between projections 34*a* of latching members 34. This allows door 28 to be moved from a closed and locked position to an open position. Secondly, movement of slider 56 breaks the electric circuit within housing 11, thus deactivating the alarm systems within tag 10. Finally, movement of slider 56 in the second direction disengages teeth 80 from the fingers of end 78. The second end 22*b* of cable 22 is then free to be withdrawn from housing 11 through aperture 76. Tag 10 can therefore be detached from product 24 without the alarms disposed in housing 11 being activated.

If, however, tag 10 is alarmed and a would-be thief attempts to open door 28 to tamper with price tag 16, then a loud, attention-getting sound is emitted by speaker 18. Furthermore, if an attempt is made to detach cable 22 and to thereby remove merchandising tag 10 from the product 24 to which it is attached, speaker 18 again emits a loud, attention-getting sound. This will also occur if cable 22 is cut. Furthermore, if an attempt is made to remove the product 24 from the store with the merchandising tag 10 still attached thereto, then the EAS tag 60 disposed within housing 11 will activate the remote store exit alarm as the product 24 is removed from the store. Furthermore tag 10 is designed that if the product 24 and attached tag 10 pass through the store exit alarms without being deactivated by way of a special key, the speaker 18 will start to emit a loud, attention getting sound and will continue to do so until battery 70 is drained. This sound from the tag 10 will therefore alert store employees and people out of the store that a product 24 has been stolen.

It will be understood by those skilled in the art that the merchandising tag could have a speaker on both the front and rear housings or at the top and/or bottom of the tag; and that the speaker, slider button, LED and door may be positioned differently on the merchandising tag without departing from the spirit of the present invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A merchandising tag for a product, the tag comprising:

a housing adapted to be connected to a product;

a moveable door mounted on an exterior wall of the housing;

a first compartment defined between the exterior wall and the moveable door; said first compartment being adapted to receive a price tag therein; and wherein the door is moveable between a closed position preventing insertion or removal of the price tag; and an open position permitting insertion or removal of the price tag; and a locking mechanism disposed on the housing and being moveable between a first position where the door is securely locked to the housing in the closed position and a second position where the door is unlocked and therefore moveable to an open position; and wherein said locking mechanism is adapted to be moved from the locked first position to the unlocked second position only by being engaged by a complementary key.

2. The merchandising tag as defined in claim 1; further comprising an attachment mechanism adapted to releasably connect the housing to the product; and wherein a portion of the attachment mechanism extends outwardly away from the housing and is selectively releasable therefrom.

3. The merchandising tag as defined in claim 2, wherein the locking mechanism is selectively engageable with the attachment mechanism; such that when the locking mechanism is in the first position, the portion of the attachment mechanism is fixedly secured within the housing; and when the locking mechanism is in the second position, the portion of the attachment mechanism is released from the housing.

4. The merchandising tag as defined in claim 1, further comprising at least one alarm mechanism disposed on the housing.

5. The merchandising tag as defined in claim 4, wherein the housing defines a second compartment and the at least one alarm mechanism is disposed within the second compartment.

6. The merchandising tag as defined in claim 5; further comprising an attachment mechanism adapted to releasably connect the housing to the product; and wherein the attachment mechanism extends outwardly away from within the second compartment in the housing.

7. The merchandising tag as defined in claim 6, wherein the attachment mechanism comprises a cable having a first end fixedly mounted to the housing; and a second end releasably received within the second compartment of the housing.

8. The merchandising tag as defined in claim 7, wherein the locking mechanism is selectively engageable with the second end of the attachment mechanism; such that when the locking mechanism is in the first position, the second end of the attachment mechanism is fixedly retained within the second compartment; and when the locking mechanism is in the second position, the second end of the attachment mechanism is removable from within the second compartment.

9. The merchandising tag as defined in claim 8, wherein the housing has an exterior wall and said wall defines an access opening into said second compartment; and wherein said second end of said attachment mechanism is receivable through said access opening.

10. The merchandising tag as defined in claim 9, wherein the second end of the attachment means includes a plurality of fingers thereon; and wherein the housing has an interior wall which defines the second compartment; and the interior wall includes a plurality of teeth complementary shaped and spaced to interlock with the fingers on the second end of the attachment means.

11. The merchandising tag as defined in claim 10, wherein the fingers interlock with the teeth when the locking mechanism is in the first position; and the fingers are not interlocked with the teeth when the locking mechanism is in the second position.

12. The merchandising tag as defined in claim 5, wherein the locking mechanism includes a slider disposed within the second compartment; said slider being movable in a first direction to cause the locking mechanism to be engaged in the first position; and the slider being movable in a second direction to cause the locking mechanism to be engaged in the second position.

13. The merchandising tag as defined in claim 12, wherein the slider includes at least one pocket formed therein; and the locking mechanism further comprises at least one magnetic arm secured within the second chamber; and wherein movement of the slider in the first direction causes the magnetic arm to be received within the pocket; and movement of the slider in the second direction causes the magnetic arm to be released from within the pocket.

14. The merchandising tag as defined in claim 13, wherein the housing has an exterior wall provided with alignment indicators adapted to indicate a location for engagement of the slider by a remote magnetic key to move the slider in the second direction.

15. The merchandising tag as defined in claim 14, further comprising an alarm mechanism disposed on the housing; and wherein the alarm mechanism is adapted to activate when an attempt is made to remove the second end of the cable from the second compartment without prior engagement of the remote magnetic key.

16. The merchandising tag as defined in claim 12, wherein the door includes at least one projection that extends outwardly therefrom and toward the housing.

17. The merchandising tag as defined in claim 16, wherein the housing defines at least one recess aligned to receive the projection from the door therethrough.

18. The merchandising tag as defined in claim 17, wherein the slider includes an aperture alignable with the recess in the housing; and wherein the projection is received through the aligned recess and aperture when the slider is moved in the first direction thereby locking the projection within the housing.

19. The merchandising tag as defined in claim 17, wherein the projection is generally L-shaped.

20. The merchandising tag as defined in claim 18, further comprising a second alarm mechanism adapted to activate when an attempt is made to open the moveable door without prior engagement of the remote magnetic key.

21. The merchandising tag as defined in claim 1, further including one of an EAS tag and an RFID tag disposed within the housing; said one of said EAS and RFID tags being adapted to activate a remote store alarm upon removal of the product from the store prior to deactivation of the said tag.

22. The merchandising tag as defined in claim 1, further including a sound producing device disposed within the housing, said sound producing device being adapted to activate upon removal of the product from the store prior to deactivation of the said one of the EAS and RFID tags.

23. A merchandising tag for a product comprising:

a housing;

a first compartment defined in the housing and being adapted to receive a price tag therein;

a door mounted on the housing and being selectively moveable in a first direction to allow access to the first compartment and in a second direction to prevent access to the first compartment;

an attachment mechanism having at least one portion thereof extending outwardly from the housing and being adapted to engage the product;

at least one alarm system disposed within the housing: and a locking mechanism for simultaneously locking the moveable door to prevent access to the first compartment; securing the portion of the attachment mechanism to the product so that the housing is not detachable from the product; and arming the at least one alarm system.

24. The merchandising tag as defined in claim 23, wherein the locking mechanism comprises a slider that is retained within the housing and is moveable in a first direction to lock the door, secure the portion of the attachment mechanism and arm the at least one alarm system; and is moveable in a second direction to release the door, release the portion of the attachment mechanism and disarm the at least one alarm system.

25. The merchandising tag as defined in claim 23 wherein the locking mechanism includes a button mounted on an exterior wall of the housing and being operationally connected to the slider disposed within the housing; said button being adapted to be physically manipulated to move the slider in the first direction.

26. The merchandising tag as defined in claim 25, wherein the locking mechanism further includes a magnetic arm disposed within an interior chamber within the housing; said magnetic arm being engageable with the slider to retain the slider in a locked position after the slider has been moved in the first direction; and wherein said magnetic arm substantially prevents the slider from being moved in the second direction.

27. The merchandising tag as defined in claim 26, wherein the housing further includes a key guide disposed on the exterior wall and aligned with the magnetic arm disposed within the interior chamber of the housing; said key guide being adapted to orient a magnetic key with the magnetic arm.

28. The merchandising tag as defined in claim 27, wherein the housing further includes a plurality of alignment indicators on the exterior wall thereof; said alignment indicators being disposed proximate the key guide and being adapted to orient the magnetic key with the magnetic arm.

* * * * *